US006667720B1

(12) United States Patent
Anderton

(10) Patent No.: US 6,667,720 B1
(45) Date of Patent: Dec. 23, 2003

(54) STEERABLE TRANSPONDERS

(75) Inventor: Rupert N Anderton, Worcestershire (GB)

(73) Assignee: Qinetiq Limited, Farnborough (GB)

( * ) Notice: Subject to any disclaimer, the term of this patent is extended or adjusted under 35 U.S.C. 154(b) by 0 days.

(21) Appl. No.: 10/009,498

(22) PCT Filed: Jun. 16, 2000

(86) PCT No.: PCT/GB00/02335

§ 371 (c)(1),
(2), (4) Date: Dec. 13, 2001

(87) PCT Pub. No.: WO00/79647

PCT Pub. Date: Dec. 28, 2000

(30) Foreign Application Priority Data

Jun. 18, 1999 (GB) ..... 9914162

(51) Int. Cl.[7] ..... H01Q 3/16
(52) U.S. Cl. ..... 343/761; 343/757
(58) Field of Search ..... 343/757, 754, 343/755, 761, 765, 781 R; H01Q 3/16

(56) References Cited

U.S. PATENT DOCUMENTS 3,745,582 A * 7/1973 Karikomi et al. ..... 343/758
4,319,242 A * 3/1982 Lewis ..... 343/876
4,529,990 A 7/1985 Brunner
4,581,615 A * 4/1986 Levy ..... 343/755
5,083,130 A 1/1992 Cardiasmenos
5,796,370 A 8/1998 Carbonell et al.
5,835,062 A * 11/1998 Heckaman et al. .. 343/700 MS
6,268,822 B1 * 7/2001 Sanders et al. ..... 342/54

FOREIGN PATENT DOCUMENTS

| | | |
|---|---|---|
| EP | 0384021 | 8/1990 |
| WO | 9847020 | 10/1998 |

* cited by examiner

*Primary Examiner*—Tho Phan
(74) *Attorney, Agent, or Firm*—Nixon & Vanderhye P.C.

(57) ABSTRACT

A steerable antenna or scanner assembly (10) is connected to signal process means (12). A housing (14) surrounds a focusing antenna (16) which is stationary relative to the housing (14), a polarisation rotator (18), a steerable reflector (20) angularly movable about a pivot axis (22), and a detector (24). Incoming radiation passes through the focusing antenna (16), has its polarization altered as it passes through rotator (18), reflects off reflector (20), Passes through rotator (18) again, encounters the antenna (16) again and this time reflects off it to focus down, passes through rotator (18) again, encounters the steerable reflector (20) again and this time passes through it to reach the detector (24). Moving the reflector (20) angularly steers the directional sensitivity of the assembly (10).

9 Claims, 5 Drawing Sheets

STEERABLE TRANSPONDERS

This application is the U.S. national phase of international application PCT/GB00/02335 filed Jun. 16, 2000, which designated the U.S.

BACKGROUND OF THE INVENTION

1. Field of the Invention

This invention relates to a steerable or directionable transponders (e.g. antennae or emitters), and especially but not exclusively to interrogator systems incorporating such transponders, and to vehicles incorporating them.

2. Discussion of Prior Art

There are times when the user (or a control processor) of electromagnetic detecting apparatus needs to look in two different directions, or when two users of a detection system each independently want to look in a different direction (for example when two people both want to have, E.M. signals analysed that come from two different directions). Sometimes signals from both directions, or fields of view, need to be analysed at substantially the same time. The immediate answer to this need is to provide two signal capture systems—for example two antennae, each under the control of a different person. This increases the cost of the overall detection system.

A second solution is to mount the signal capturer (e.g. antennae or camera) on a turntable or gimbal mechanism so that it can be rotated to look in the two directions at different times and ensure that the turntable can be moved fast enough to provided the required response time for both users (or the system) to see their desired field of view substantially simultaneously. This is difficult if a fast turning time (e.g. less than 1 second, and especially if <200 ms) is required with a substantial mass of antennae. The motor drives needed will be large and expensive, and furthermore gimbal arrangements are susceptible to mechanical failure or damage due to exposed moving parts. A gimbal also requires a large volume.

Phased arrays could in theory be used to steer the signal capturer/antennae, however at high frequencies (e.g. GHz-range) the technology is not yet mature enough to be practical or affordable, especially for the case of broad-band signals.

One area where it is believed that a steerable antennae or interrogator would be useful is in the field of vehicles. For example it is known to have radar-controlled systems on cars which prevent a car from coming too close, whilst travelling, to the vehicle in front. In order to look at a sufficiently wide field of view using cheaper, practicable, equipment it may be necessary to have more than one antenna/detector. By having a steerable antenna it is possible to provide fewer antennae and yet still look across a wide enough field of view. It may be possible to provide only one antenna on the vehicle.

It may be desirable not only to know that there is a vehicle in front, but also to identify it as being one of a known kind. For example road trains and tram convoys have been proposed in which a trailing vehicle follows a lead vehicle automatically at a controlled distance and speed, and it may be desirable for the trailing vehicle to identify the lead vehicle, for example by interrogating a transponder, or by processing some other identifying signal from the lead vehicle. It may also be desirable for the signal from the lead vehicle to contain additional data beyond that it is there, for example, its identity, what it is carrying, its braking distance, amount of fuel it has on board etc.

SUMMARY OF THE INVENTION

It is an aim of one embodiment of the present invention to enable an antenna to be steerable at a speed of the order of 100 ms or so (when operating at GHz frequencies or above).

According to a first aspect the invention comprises a steerable antenna or scanner assembly having an antenna and a steering reflector, the steering reflector being adapted to be controlled by control means.

Thus the steering reflector is moved, and not the entire assembly. This enables the lower mass reflector to be moved faster. Also, since it is a reflector it can be moved through only half of the angle the entire assembly would have to be turned (if the movement is angular movement). Preferably the antenna is of the order of 50 $cm^2$ or 100 $cm^2$ at least in area. It may be larger or smaller, depending upon the desired resolution, and upon the wavelength used.

The steering reflector is preferably capable of being moved between a first position in which the assembly has a first field of view and a second position in which the assembly has a second field of view in a time of about half-a-second or less. Most preferably the steering time is not more than about 0.2 seconds, 0.1 second, or less, possibly about 10 ms. The steerable reflector may be moved in the steering time through an angle that is at least 10°, or 20°, or 40°, or 60°, or 90°, and is preferably movable in that time through at least about 90°.

The assembly is preferably adapted to detect or emit electromagnetic radiation, preferably of millimeter wavelengths, or possibly longer or shorter wavelengths. A wavelength of 36–40 GHz, or about 77 GHz, or about 95 GHz may be chosen.

The assembly may be housed in a protective housing, which may be of the order of 5–20 cm or more wide and may be about 10–20 cm or more tall, and may be about 1–20 cm deep.

The antenna is preferably stationary (relative to a housing or mounting frame), with the steering reflector being adapted for movement.

The assembly may direct incident radiation from a chosen direction to a detector via at least one reflection of the incident radiation. This enables it to be compact. Incident radiation from the chosen direction may be directed to the detector via at least two reflections of the incident radiation within the assembly, or with only, or no more than two reflections of the incident radiation within the assembly.

There maybe a selective reflector which in use transmits at least a substantial part of an incident wave under certain conditions and which reflects at least a substantial part of an incident wave under other conditions, and in which the arrangement is such that radiation reaching a detector has been both reflected from the selective reflector and transmitted through the selective reflector. Substantially all incident radiation that encounters the selective reflector in a particular wavefront may be transmitted, or substantially all may be reflected. The steering reflector may comprise the selective reflector.

A polarisation changer maybe provided to effect a change of polarisation of radiation. The polarisation changer may provide in use the change of polarisation between the selective reflection or transmission of the incident radiation by the selective reflector and may transmit or reflect the radiation dependent upon the polarisation state of the radiation incident upon it. The assembly may be adapted to reflect off the steering reflector radiation incident upon the assembly from a chosen direction. The antenna may be a focusing antenna, and the antenna may be adapted to focus the polarity-altered radiation reflected off the steering reflector onto a detector. The polarisation changer is preferably provided in the path of the radiation between its reflection from the steering reflection and the focusing antenna, the arrangement being such that the radiation reflected off the steering reflector has its polarity altered before re-impinging upon the steering reflector and passing through the steering reflector to reach the detector.

The antenna may be arranged relative to the polarisation changer such that the radiation incident upon the assembly from a chosen direction passes through the antenna before encountering the polarisation changer.

The antenna and/or steering reflector may comprise substantially parallel lines of material. The polarisation changer may rotate the polarity of a linearly polarised wavefront by substantially 45° as the wavefront passes through it. The steering reflector may be movable angularly about an axis.

A circular polarisation to linear polarisation converter may be provided. There are certain advantages to communicating over distances using circularly polarised radiation. The circular polarisation to linear polarisation converter may be provided in front of the antenna, so that a wavefront incident from a chosen direction is incident upon the converter before it is incident upon the antenna.

Circular to linear polarisation change means may be provided. The circular to linear polarisation change means preferably comprises one or more meanderlines, or quarter-wave plates.

Polarisation change means may be provided (such as a linear polarisation in one plane to linear polarisation in another plane). The steering reflector is in one embodiment reflective for waves having a particular polarisation and transmissive for waves having a different polarisation.

The assembly is preferably adapted to receive and detect incoming radiation, but it may be an emitter. The antenna is preferably a focusing antenna.

A polarisation changer is preferably provided adjacent the antenna. The polarisation changer preferably comprises a panel of polarisation-changing material. It may serve to stiffen the antenna, or the antenna may stiffen the polarisation change material. The antenna may comprise a dish and a sheet of polarisation change material may be provided extending to the peripheral edge region of the dish.

Preferably the configuration of the assembly is such that the antenna is in front of the steerable reflector (relative to an expected direction of externally incident radiation (field of view). Preferably the antenna is in front of the detector. Preferably the steerable reflector is also in front of the detector, preferably between the antenna and the detector. Preferably the polarisation changer is between the antenna and the steering reflector. The steering reflector may be the only movable optical element.

According to a second aspect the invention comprises a field of view investigatory system having an antenna assembly in accordance with the first aspect of the invention and a signal processor, the antenna assembly having a detector which feeds signals to the signal processor.

The system may comprise a steerable interrogator system. The signal processor is preferably adapted to analyse received signals and determine whether they contain an element of a predetermined known kind.

It may be capable of interrogating a first field of view and a second field of view substantially simultaneously to determine whether the signals received by the detector from the fields of view contain an element of a known kind. A decoder may be provided which in use decodes detected signals to make available information carried by the electromagnetic radiation. There may be encryption-reading means to decipher an encrypted signal.

Protection is also sought for a vehicle provided with an antenna assembly in accordance with the first aspect of the invention or with a system in accordance with the second aspect of the invention. The vehicle may be provided with an angularly movable component and the steering reflector may be controlled at times to be at an angular position determined by the angular position of the vehicle's angularly movable component.

The vehicle may have a first angularly moveable component and a second angularly movable component each angularly movable independently, and in which the steering reflector is controlled at times to be at a first angular position determined by the angular position if the first angularly movable component, and soon after, at substantially the same time, to be at a second angular position determined by the angular position of the second angularly movable component. The first and/or second angularly movable components may comprise an imager, such as a camera.

According to another aspect the invention comprises a method of changing the direction of the field of view of an antenna assembly, the method comprising having a stationary antenna and a movable steerable reflector, movement of the reflector moving the sensitivity response pattern of the assembly.

The method preferably comprises receiving incident radiation, but it could comprise emitting radiation to different directions.

The method may comprise either transmitting or reflecting an incident wavefront the one time (preferably the first time) that the wavefront encounters the steerable reflector, and arranging for the wavefront to encounter the steerable reflector a further time, at which time the wavefront is transmitted or reflected (the opposite of the said one time encounter with the steerable reflector). The incident wavefront may be polarised. The transmission/reflection characteristics of the steerable reflector may depend upon the polarisation state of the radiation encountering it. There may be a change in polarisation of the wavefront between its first, or said one, interaction with the steerable reflector and its further interaction with the steerable reflector.

Preferably the polarisation of the wavefront at at least one of its encounters with the steerable reflector is linear.

According to a further aspect the invention comprises either i) a method of interrogating a plurality of fields of view substantially simultaneously to determine the presence or absence of a predetermined signal, or ii) providing apparatus to achieve the method of i); the invention further comprising having a detector feed detected signals to a signal processor to perform the interrogation of the signals, and having a scanner that captures data which is fed to the detector rapidly change its field of view by providing the scanner with apparatus that is in accordance with the first aspect of the invention or which operates in accordance with any of the other aspects of the invention.

It will be appreciated that there it may be a threshold size of antenna at which it is just as easy to move the antenna as to have a smaller steerable reflector. It is believed that if the antenna is smaller than about 2 cm×2 cm it may be uneconomic to use the present invention (but it may nevertheless be applied).

Preferably the antenna is at least as large as about 2 or 3 cm×2 or 3 cm, or 5 cm×5 cm, or 10 cm×10 cm, or 20 cm×20 cm, or 30 cm×30 cm, or even 50 cm×50 cm, or 1 meter or more×1 meter or more. It should not be assumed that the antenna is necessarily square and the above size ranges could be diameters. An antenna with a size in a range extending between any of the points mentioned is envisaged. In terms of area, the antenna may have projected area of about 4 $cm^2$, 9 $cm^2$, 25 $cm^2$, 50 $cm^2$, 100 $cm^2$, 500 $cm^2$, 1,000 $cm^2$, 2,500 $cm^2$, 10,000 $cm^2$, more, or be in a range defined by any of those points.

The mass of the antenna may be 50 g or more, or 100 g, 500 g, 1 kg, 10 kg, or more (or be between a range defined by the above values).

The steerable reflector is preferably not too big. It may be about 30 cm×30 cm (or 30 cm diameter), or less. It may have sides, or a diameter that is about 20 cm, 15 cm, 10 cm, 5 cm, 2 or 3 cm, or less, or in a range defined by any of those points. If a steerable reflector above 30 cm in size is wanted, it may be desirable to evacuate a chamber in which it resides to reduce air drag. It is possible to envisage large steerable reflectors being formed as a membrane in a frame (e.g. metalised mylar) and these could be 1 m in size.

It will be appreciated that an antenna is typically a three-dimensional structure, such as a dish, and that for any given projected area a substantially planar steerable reflector will be less massive, and therefore easier to steer.

The steerable reflector may have a projected area that is smaller than that of the antenna, possibly ¾ of the area or ½ of the area, or less. The more the antenna focuses a beam the smaller the steerable reflector may be, and the closer the steerable reflector is to the focus the smaller it may be. Alternatively, the steerable reflector may have an area that is substantially the same as that of the antenna. The steerable reflector may be provided before focusing of an incident wave.

One particular embodiment of the antenna assembly is sized and adapted to operate at mm wavelengths. The invention may have an especial (but not exclusive) application at radio to sub mm wavelengths. If the wavelength gets shorter, to I.R. or optical, it can be awkward and expensive to find appropriate polarisers.

Preferably the antenna assembly operates over quite a broad bandwidth, for example 1–10 GHz (or more), most preferably at least 1 GHz, and may operate over a band of least 1 or at least 5 GHz. Preferably the assembly is adapted to operate over a bandwidth of 5–20%, or 5–10% or 15% of the central, nominal, operating frequency (for example it may have bandwidth of about 5 GHz at 30 GHz).

The speed of moving the steerable reflector from one side to the other side of its range of movement may be about 1/100 second or less, 1/50 second, 1/20 second, 1/10 second, 2 or 3 tenths of a second, half-a-second, or 1 second or more. The speed of movement may be within a range defined by any combination of the above values.

The invention could be considered to be a way of improving the speed of canning an antenna/wave-capturer from a first angle to a second angle by using a steerable mirror or reflector.

Using this in the field of mm waves is considered advantageous compared with how mm wave systems have looked to different fields of view in the past.

Having a steerable antenna that is selectively transmissive or reflective gives advantages.

BRIEF DESCRIPTION OF THE DRAWINGS

An embodiment of the invention will now be described by way of example only with reference to the accompanying drawings, of which.

DETAILED DISCUSSION OF EMBODIMENTS

Figure 1A:
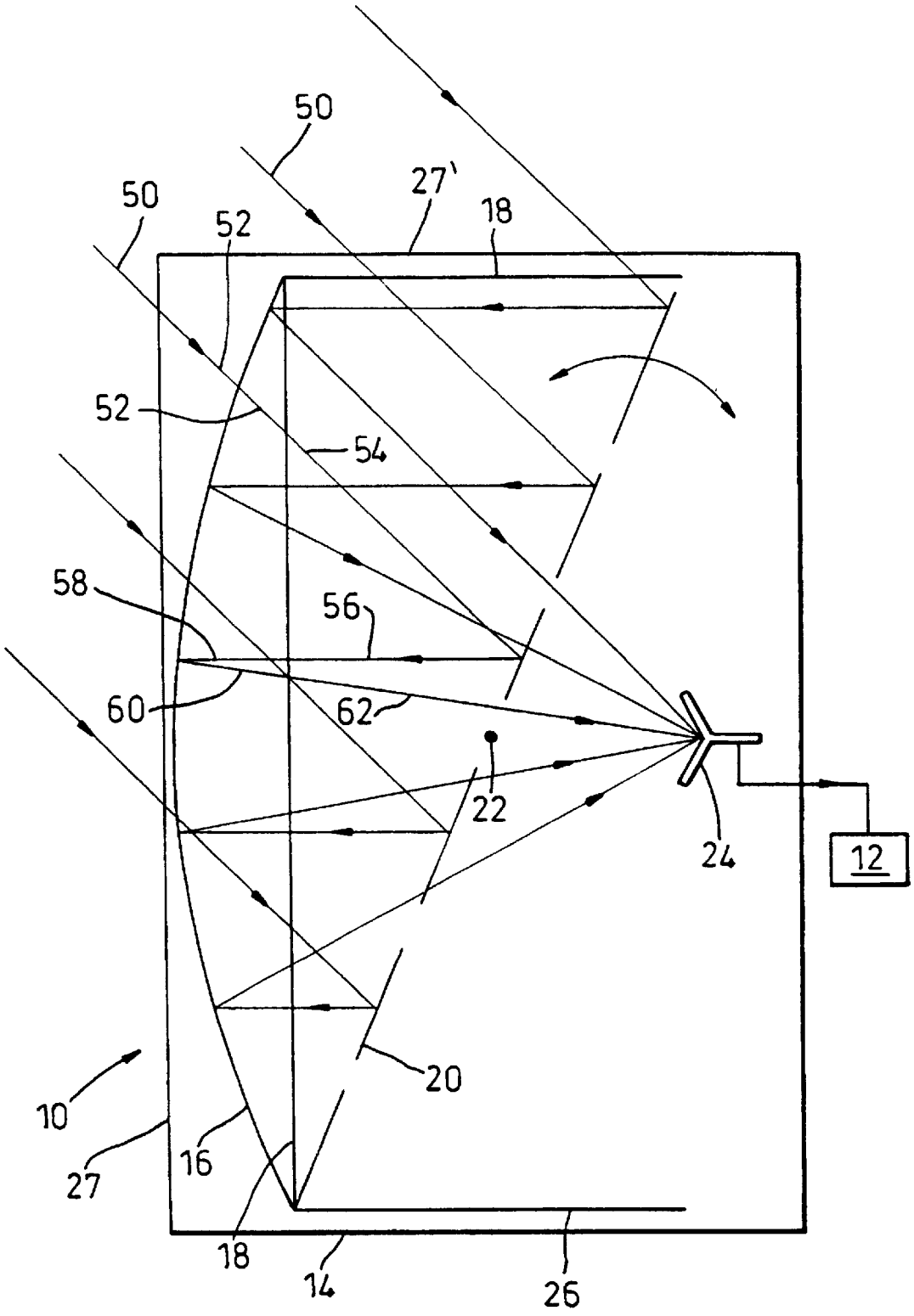
FIG. 1A schematically shows a steerable interrogator system in accordance with the invention.

FIG. 1A shows a plan view of an opto-mechanical antenna assembly, or scanner, 10 connected to signal processing means 12. The antenna assembly 10 comprises a housing 14 (which in this case is closed to protect its contents from any hostile environment), an antenna 16 which is stationary relative to the housing 14, a polarisation rotator 18 comprising a panel of polarisation-rotating material mounted so as to be fixed relative to the antenna and housing (in fact this is a box having side walls as well as a front wall), a steerable reflector 20 (or flapper plate 20) which is mounted so as to be angularly movable about pivot axis 22, a detector (or horn) 24 provided stationary relative to the housing 14, and a support frame 26 provided to support the antenna 16, polarisation rotator 18, and steerable reflection 20, and detector 24. A polarisation-converter 27 is provided at the front of the housing, the converter 27 converting circularly polarised radiation into plane polarised radiation. The converter 27 also has side walls 27' extending along the side of the housing (and may have a top and a bottom wall as well as the front wall, and the preferable side walls 27'). The housing 14 is provided with mounting formations 28 (shown on FIG. 1B) to enable the housing to be mounted to another article, in this case to a vehicle. The housing may be mounted on the exterior of the vehicle.

Figure 1B:
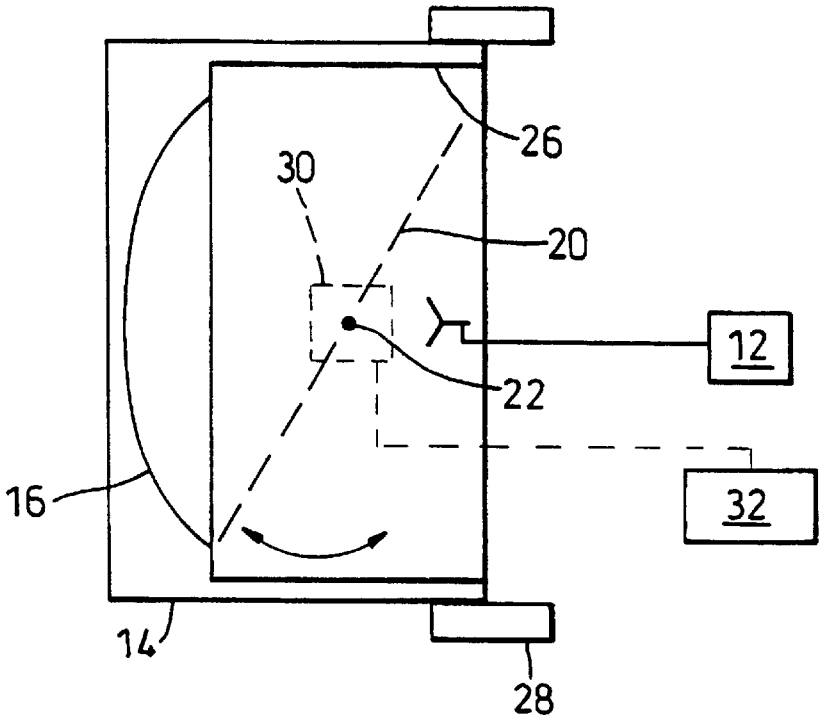
FIG. 1B schematically shows a detail of the system.
Figure 2:
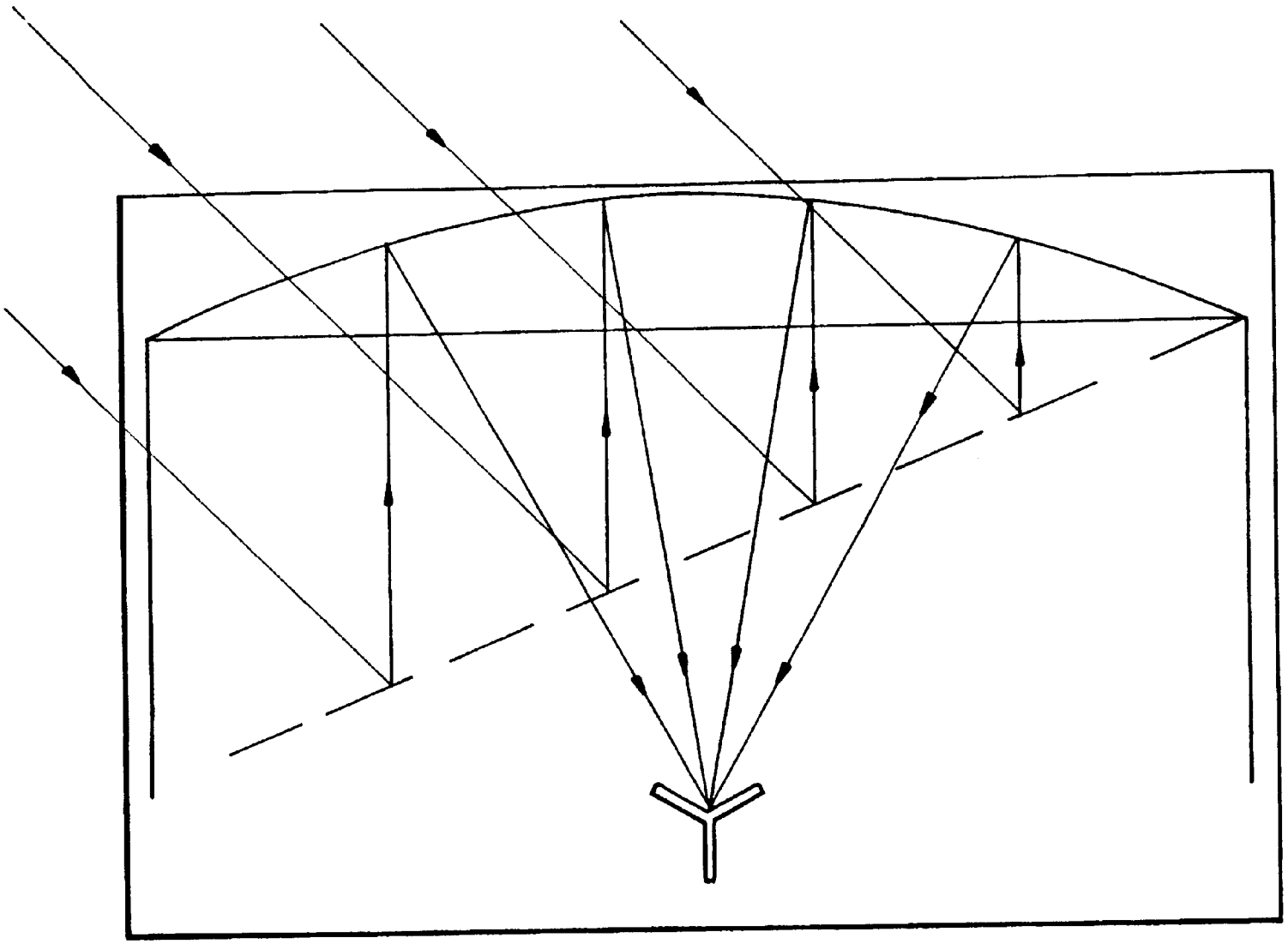
FIG. 2 schematically shows the system of FIG. 1, but with its steering component steering the assembly to look in a different direction.

FIG. 1B also illustrates more clearly the fact that there is space within the housing for the flapper plate 20 to move angularly about the axis 22 without hitting the sides of the frame 26. It also shows motor drive 30 which moves the flapper plate about axis 22 and which is controlled by controller 32. Signal processor 12 and controller 32 may be part of the same overall control system or computer. They may in some embodiments be provided within the housing, or as a unit mounted separately, possibly near the housing.

The antenna 16 is a focusing antenna and comprises a curved polarising dish having a large number of equi-spaced parallel copper wires or lines provided on a substrate (e.g. PTFE/glass fibre) inclined at 45° to the vertical. This makes the dish transmissive to an electric polarised component that is normal to the lines and reflective for an electric component that is parallel to the lines.

Figure 3:
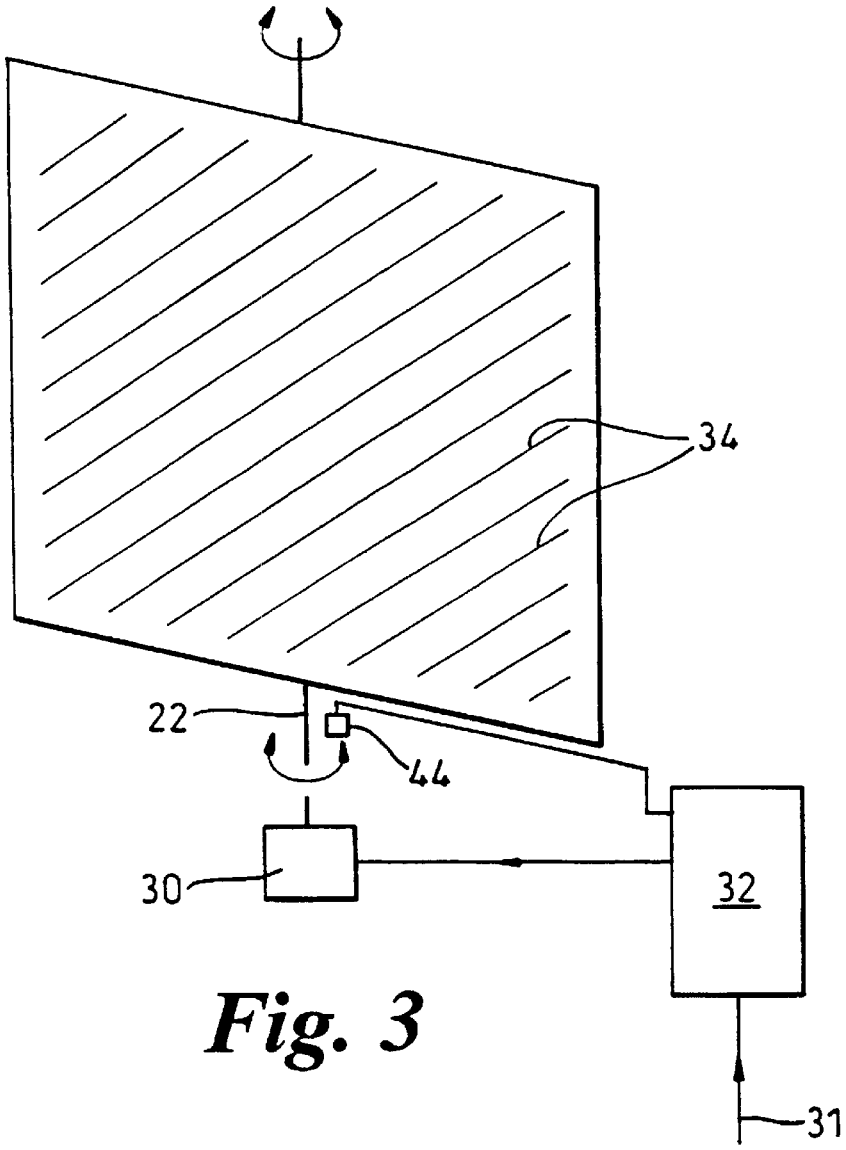
FIG. 3 schematically shows the steering component of FIG. 1 in more detail.

The steerable reflector 20 is shown in FIG. 3 and also has a large number of parallel metal wires or tracks 34 that have a polarisation plane at 45° to the polarisation plane of the polarising dish of the antenna 16.

Figure 4:
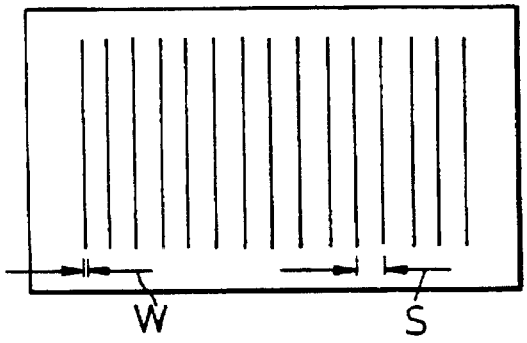
FIG. 4 shows another component of the system of FIG. 1.

FIG. 4 shows a polarising grid for a 36 GHz to 40 GHz waveband. The line width W is about 180 $\mu$m, and the spacing S between adjacent lines is about 300 $\mu$m. It is more than 95% efficient in the given waveband.

Figure 5:
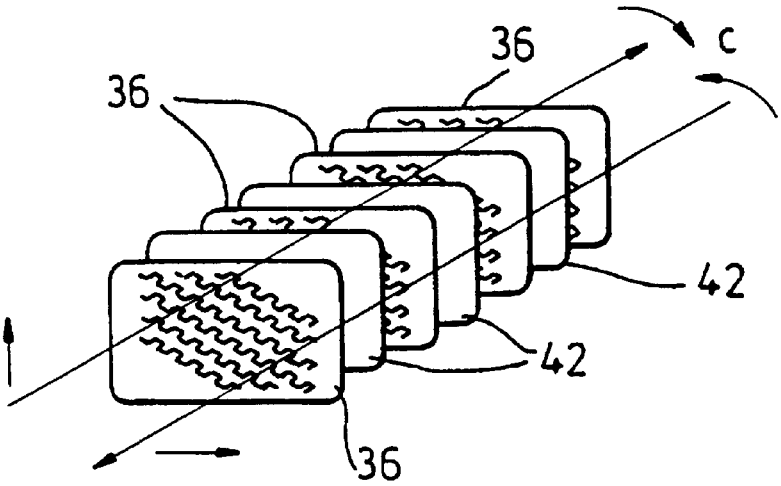
FIG. 5 shows a meanderline assembly used in the system of FIG. 1.
Figure 6:
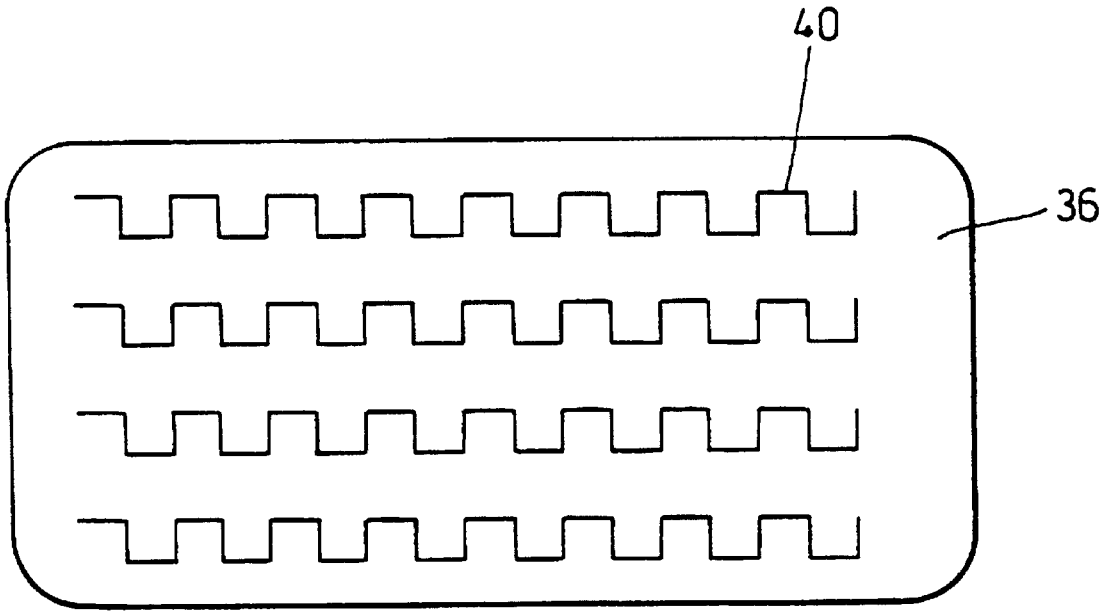
FIG. 6 shows a meanderline sheet used in the meanderline assembly of FIG. 5 in more detail.

The polarisation converter 27 is shown in more detail in FIGS. 5 and 6. It comprises a meanderline stack of a plurality (four in this case) of grids or layers 36 of a substrate 38 (eg PTFE/glass fibre) with parallel etched metal meandering lines 40 on each layer, with the layers 36 being supported by dielectric layers 42. The meanderline grids convert circular polarisation to linear polarisation (and vice versa). Meanderlines are discussed in the paper "Analytical Model of a Multi-Layer Meander-Line Polariser Plate with Normal and Oblique Plane Wave Incidence" by Ruey-Shi Chu and Kuan-Min Lee, IEEE Trans Antennas Propagation AP-35, No. 6 June 1987.

The polarisation rotator 18 comprises a ferrite sheet, in this case Barium Hexa-ferrite. It has a thickness chosen to achieve a 45° rotation of incident radiation at the selected bandwidth of use. In this case the thickness was chosen to give a 45° rotation at 37 GHz (about 2mm). Matching layers of dielectric (a plastics material such as ABS) extend over both side faces of the ferrite as a dielectric matching material to reduce reflections of the faces of the ferrite polarisation plane rotator.

The detector 22 was in a trial a pyramidal aluminium feel horn, but a circular horn is preferred. In the trial system, the flared part of the horn was 16 mm long, the aperture was 16.6 mm in the magnetic plane and 12.3 mm in the electric plane, which gave an overall gain of 14–15 dBi. The overall gain of the system was arranged to be about 33 dBi.

It is desired to avoid mounting the horn at 45° to the plane of polarisation to the radiation it receives. A double meanderline structure (not shown), linear→circular→linear at 45° is mounted in front of the horn, and this comprises two of the meanderline structures shown provided back-to-back and rotated 45° with respect to each other.

The overall antenna assembly, or scanner, in a trial system was about 20 cm wide, 30 cm tall and 20 cm deep. Moving to shorter wavelengths, or sacrificing optical quality/resolution can allow smaller scanners.

FIG. 3 shows the flapping grid (steerable reflector) 20 driven by the drive motor 30, which comprises a solenoid. The grid 20 has an axle (not shown) with an encoder 44 associated with it. The encoder provides position signals to the controller 32, identifying the angular-position of the axle of the flapping grid.

Referring to FIG. 1, and the ray traces shown on it, circularly polarised mm waves 50 enter from the left. These waves may be emitted by an object being interrogated, or reflected from it. The circularly polarised waves 50 are converted to linearly polarised waves 52 by the meanderline converter 27. They pass through the curved focusing grid/dish 16 because the plane of polarisation is parallel to its plane of polarisation. The waves 52 then pass through the ferrite Faraday rotator 18 where the plane of polarisation of the waves is rotated by 45° (ray referenced 54 at this portion). The waves then strike the steerable reflector/flapping grid 20 (which does the scanning of the field of view), and because they are cross-polarised with respect to this grid the waves reflect off it (waves referenced 56 at this point). After travelling back through the ferrite Faraday rotation 18 and picking up a further 45° rotation of polarisation (waves referenced 58 at this point), the waves reach the curved focusing dish 16 and are now cross-polarised with respect to this grid and so reflect off it (waves referenced 60 at this point) and are focused down by it. The waves 60 cross the ferrite polarisation rotator 18 again and pick up a further 45° rotation of their polarisation (waves referenced 62 at this point). The waves 62 pass through the flapping grid 20 since they are now polarised parallel to it. The waves focus on the phase center of the feed/detector 24.

Angular movement of the flapping grid/steerable reflector, which is much less massive than the entire antennae assembly 10, produces a deflection of the deflected field of view of twice the angle of movement of the grid 20. This results in a fast and compact scanner.

The configuration chosen for the antenna assembly, with the waves passing through the antenna dish, reflecting off the steering reflector, reflecting off the antenna dish, and passing through the steering reflector to get to the detector feed horn, achieves a compact in-line system, and avoids having the feed horn obstruct the path of the waves (which would reduce the performance of the system).

In the trial system the box sections of the meanderline converter and of the Faraday rotator 18 reduce performance for waves towards the edge of the scanner, near to the box corners. It may be preferred to use a curved profile rotator 18 and/or an anti-reflection coating for the meanderline box and/or the rotator 18 box.

The system performance of a preferred embodiment is as follows: Scanner Requirement:

| | |
|---|---|
| Gain: | 30 dBi |
| Scan Angle: | ±45° in azimuth |
| Feed: | monopulse feed in azimuth |
| Size: | about 2000–6000 $cm^3$ |
| Response time (full deflection of steerable reflector) | at least as good as 100 ms, preferably 10 ms or better |
| Polarisation received by scanner: | circular |
| Operating frequency | 36 GHz to 40 GHz |
| Effective aperture | 150 mm circular |
| Theoretical gain at aperture: | 34.8 dBi |
| Angle at feed subtended by aperture: | 95.2° |
| Feed: | horn, 20 dBi illumination |
| Curved focusing grid: | spherical surface focal length 85 mm |
| Distance steerable reflector is behind focusing grid: | 50 mm |

The scanner may be part of an active detection/identification system, or a part of a passive system.

The scanner may be mounted on a movable component, which may have a field of view, such as a camera.

The controller 32 may control the steerable reflector as a slave to the movement of another component of a system, for example a camera. FIG. 3 shows an electrical input signal 31 representative of the position or movement of a pointable element, such as a camera, being fed to the controller 32.

The scanner or antenna assembly 10 may be part of an interrogation system which detects radiation from an object and analyses it to identify if the object is of a known kind. The detected radiation may be processed to decode information that it contains, preferably by the control means 32. The control means 32, the scanner/antenna assembly 10, and the drive motor 30 could be provided as a unit.

Another field where the present invention finds application is in traffic monitoring and control. For example a toll booth could use a scanner in accordance with the invention to look at cars and lorries fitted with appropriate transponders to identify themselves as a car or a lorry, and which company's or person's credit account to debit as the cars and lorries drive past the toll booth/automatic remote tolling station. A roadside scanner, or scanner provided on a gantry, may need to scan to slightly different fields of view very quickly to interrogate traffic in different lanes of the road. This avoids moving a bulky camera.

A further application may be for site security, for example at a gate or barrier. A scanner could look for encoded security data emitted by emitters to determine whether a barrier is opened or not. A single scanner could serve a plurality of gates/barriers by scanning rapidly to adjacent barriers.

The scanner may operate at a radiation frequency of 77 GHz.

The resolution of the scanner could be improved by using a monopulse feed at the detector 24.

The scanner 10 may be used in an imaging system, or a non-imaging system, such as an interrogation system.

Figure 7:
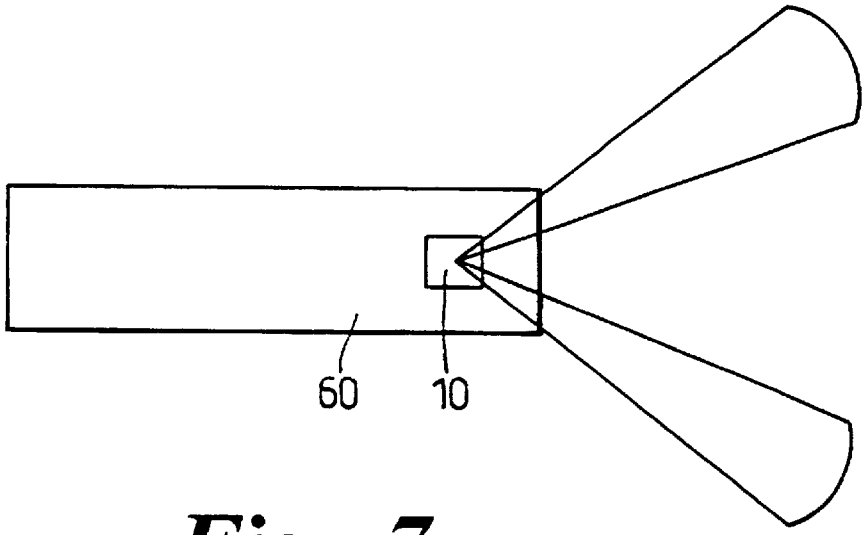
FIG. 7 schematically shows a vehicle fitted with the steerable interrogator of FIG. 1.

FIG. 7 shows a vehicle 60 provided with a scanner 10 capable of looking in two directions, in this case substantially 90° apart. Should vehicles, such as cars, have transponders giving them an identity a vehicle such as a vehicle 60 could be used to identify other vehicles, possibly in order to contact their owners at a later date to discuss traffic violations (e.g. the waves emanating from other vehicles could be used to establish road speed).

It will be appreciated that whilst the reflections of radiation used in the specific embodiment of FIGS. 1 to 6 enable the physical size of the scanner to be kept small, each reflection incurs a loss of signal, and too many reflections can degrade performance to an unsatisfactory level.

Although discussed as a receiver, the antenna assembly 10 could, of course, be used as an emitter if the feed horn 24 were replaced by a suitable radiation source and the polarisation changing component 18 were reversed. Alternatively a separate emitter could be provided which uses some, all, or none of the optics of the antenna assembly (for example in an active steerable interrogator system).

It will be appreciated whether in a passive or active system the steerable reflector can be moved much faster than moving an entire camera, or housed unit. The steering reflector is also moved through only half the angle that the whole unit would have to turn. It also makes it possible to have a single unit looking at different fields of view practically simultaneously.

The antenna assembly is capable of operating over quite a wide band, for example in one embodiment it operates off the Ka-band (26.5 GHz to 40 GHz). It may operate over the W-band (75 Ghz–110 Ghz), and may, for example be configured for 77 GHz.

It may be desirable to have two, or more, steerable reflectors in the wave path. The plurality of steerable reflectors may be controlled to turn through the same angle, or through different angles to each other. By reflecting a wave from more than one steerable reflector it is possible to increase the change of angle between a first and second field of view by a greater extent, whilst still only moving the steerable reflectors through a relatively smaller angle (and hence faster than if a single reflector had to move half of the change of field of view angle).

The invention is presently envisaged having benefit in situations where a signal-collecting (e.g. focusing) antenna is too big to move at a desired speed. The size of the antenna is associated with gain, and so the antenna should not be made too small. The minimum acceptable size will depend upon the frequency of radiation and gain/resolution required. The present invention allows bigger antenna effectively to be moved at fast speeds by not moving the antenna, but instead moving the steering reflector. Of course, it is envisaged that in some situations one may want to move the antenna and have a steerable reflector—better performance would still be obtained.

Other ways to provide a selective reflector/transmitter component might be to use frequency changes (but the technology to do this is difficult and expensive for a large device, and is inefficient), or to use phase changes (but this is not practicable since phase may not be known, and the phase will change with scan angle and position across the antenna). Nevertheless, an alternative selective reflector/transmitter may be possible.

Although described as an RF system, the invention may also have application at other frequencies, such as optical, I.R., U.V., or even X-Ray.

What is claimed is:

1. A steerable antenna or scanner assembly comprising:

an antenna;

a steering reflector; and a detector of radiation, wherein the steering reflector substantially transmits, incident radiation having a first polarization state and substantially reflects incident radiation having a second polarization state, and radiation reaching said detector has been both reflected from, and transmitted through, the steering reflector.

2. An assembly as claimed in claim 1 further including control means for moving the steering reflector repeatedly between a first position and a second position such that the assembly views two determined regions at different times.

3. An assembly as claimed in claim 1 further including a polarisation state changer, located between said antenna and said steering reflector for changing polarisation of radiation passing through the state changer wherein radiation of said first polarization state reflected from the steering reflector passes through the state changer, is then reflected from the antenna and passes again through the state changer changing the polarization to the second polarization state.

4. An assembly as claimed in claim 1 further including a linear/circular polarisation state changer is provided adjacent the antenna between the antenna and the steering reflector for changing linearly polarized radiation into circularly polarized radiation and for changing circularly polarized radiation into linearly polarized radiation.

5. An assembly as claimed in claim 1, wherein the antenna includes a dish and a sheet of polarisation state change material provided extending to peripheral edge region of the dish.

6. A field of view investigatory system including an assembly as claimed in claim 1 and further including a signal processor responsive to said detector feeding signals to the signal processor.

7. A system as claimed in claim 6, wherein the signal processor is adapted to analyze received signals and to determine whether they contain a characteristic component.

8. A system as claimed in claim 6, wherein the system has a decoder for decoding signals to make available information carried by the incident radiations.

9. A vehicle provided with a system as claimed in claim 6, wherein the system further includes a first angularly moveable component and a second angularly moveable component each angularly moveable component is independently moveable, wherein the steering reflector is controlled at times to be at a first angular position determined by the angular position of the first angularly moveable component, and soon after, to be at a second angular position determined by the angular position of the second angularly moveable component.

* * * * *